United States Patent [19]

Bennett et al.

[11] 4,142,561

[45] Mar. 6, 1979

[54] FILLING MACHINE WITH ENVIRONMENTAL CONTROL

[75] Inventors: Richard N. Bennett, Arbutus; Lawrence W. Buckley, Baltimore, both of Md.

[73] Assignee: National Instrument Company, Inc., Baltimore, Md.

[21] Appl. No.: 810,171

[22] Filed: Jun. 27, 1977

[51] Int. Cl.[2] ..... B65B 3/12

[52] U.S. Cl. ..... 141/82; 141/181; 222/146 R

[58] Field of Search ..... 34/342; 62/265; 141/1, 141/11, 47, 48, 51, 69, 70, 82, 94, 97, 131, 180, 181, 183, 198, 263, 270, 284, 324, 392; 222/146 R, 146 HE, 152, 530

[56] References Cited

U.S. PATENT DOCUMENTS

| | | | |
|---|---|---|---|
| 3,698,450 | 10/1972 | Taylor et al. | 141/180 |
| 3,792,801 | 2/1974 | Baker et al. | 222/146 HE |
| 4,000,765 | 1/1977 | Lydiksen | 141/181 |
| 4,051,878 | 10/1977 | Ohmeis et al. | 141/82 |

*Primary Examiner*—Richard E. Aegerter
*Assistant Examiner*—Frederick R. Schmidt
*Attorney, Agent, or Firm*—Craig & Antonelli

[57] ABSTRACT

A filling machine for filling containers with a product that is not liquid at normal room temperature, in which the filling nozzle or nozzles to be lowered into a respective container as well as the associated filling units are housed within a temperature-controlled chamber, in which the temperature is maintained such that the product supplied in liquid condition remains in substantially liquid condition during its passage through the filling unit and discharge nozzles.

32 Claims, 5 Drawing Figures

FILLING MACHINE WITH ENVIRONMENTAL CONTROL

The present invention relates to a filling machine for filling predetermined amounts of a product into containers and more particularly to such a filling machine with environmental control.

Filling machines for filling liquid products into small containers such as bottles, ampules, etc. are known in the prior art (U.S. Pat. Nos. 3,237,661 and 2,807,213). While these prior art machines worked quite satisfactorily for products that were liquid at room temperature, a problem has always existed in filling molten material that had to be liquefied by the application of heat. Various attempts were made in the prior art to solve this problem. For example, in one such attempt, heating bands were placed around the cylinders of the pumps and/or heating tapes were placed on the intake hose and discharge hose while heating cartridges were used with the valves. At best, these makeshift arrangements represented only a partial solution because parts of the mechanism would become overheated while other parts were underheated and the material tended to congeal in the system. These shortcomings thus constituted a constant source of irritation to both manufacturer and customer and could be obviated only by operating the machine in a room heated to the molten temperature of the product, thereby requiring, for example, a room temperature of about 140° F., representing the melting point of a deodorant. Apart from discomfort to the operating personnel as a result of this relatively elevated ambient temperature and possible problems with governmental regulations stemming therefrom, this approach was beset by obvious problems concerning the length of service life of certain parts of the filling machine, such as the electric motors, the electronic controls and the components thereof, etc. which were rated for normal operation at much lower temperature.

The present invention is therefore concerned with the task to eliminate the aforementioned shortcomings and drawbacks by extremely simple means and to provide a filling machine of the type described above which is able to handle molten material which has to be liquefied by the application of heat during the filling operation, without impairing the length of life of the machine and its parts and without discomfort to the operating personnel.

The underlying problems are solved according to the present invention in that the filling machine is equipped with an environmental control in the form of a heat-insulated chamber which is kept at a predetermined temperature and into which are placed only those parts that actually handle the molten product during the filling operation, namely the pumping mechanism, including pumps and nozzles, so as to keep the product in molten condition and thereby permit the filling operation thereof without any problem.

With a filling machine according to the present invention equipped with environmental control, it is only necessary to provide a continuous, external supply of molten material for the machine which then takes over the function to fill the molten material into containers by the use of conventional pumps, valves, filling nozzles, etc., housed within the chamber maintained at the predetermined temperature or within a predetermined temperature range.

According to another feature of the present invention, an auxiliary tank or reservoir may also be accommodated within the chamber which may be equipped with a level control, such as a float valve mechanism to maintain constant a predetermined level of the molten product within the auxiliary reservoir. If so desired, the auxiliary tank may also form part of a circulatory system, maintaining the molten material under pressure so as to keep it circulating and thereby minimize temperature fluctuations. However, in most cases where the temperature is not critical, the auxiliary tank equipped with a float valve is sufficient so that the valve opens when the pump calls for more material and permits more molten material to move into the chamber from the external supply of such molten material.

According to still a further feature of the present invention, intentional leaks are provided in the chamber so as to enhance the air movement within the chamber and thereby keep the temperature within the chamber as uniform as possible.

While any suitable temperature control of known type may be used with the filling machine of the present invention, a forced-air temperature control is preferred because it permits the chamber to be brought to the desired temperature much faster and assures a more uniform air distribution within the chamber, thereby minimizing any temperature differentials within the chamber. Heat cartridges over which air is blown by a blower have proved particularly effective for the present invention. The uniformity of the temperature within the chamber is greatly enhanced by intentional leaks, such as formed by the openings through which extend the nozzles with a bottom fill mechanism as well as the drive shafts for the pumps. Additional leakage places are formed by slidable panels delimiting the chamber which are slidingly held within non-sealed guides. To economize the energy requirements for the temperature control, the panels delimiting the chamber are thermally insulated, and at least some of these wall panels are made from a transparent plastic material with inherent heat insulation properties, such as a polycarbon plastic of the type sold under the trademark "LEXAN". Since the pump as well as the nozzles are made of metal such as stainless steel, and since the molten material is not stationary within the pumping and discharge mechanism but moves out constantly, it remains in the molten condition throughout the entire filling system and hardens only after being filled into the container. The metal from which the nozzles are made will retain the heat and thus does not cool down immediately, even if exposed briefly to the ambient temperature during a fraction of each cycle while being lowered out of the chamber into the containers to achieve the bottom-fill. Since machines of this type can operate at about 20 r.p.m., the nozzles will be exposed to ambient air less than 1½ seconds per cycle and will thus stay at a temperature keeping the product in molten condition which is also enhanced by the fact that warm air surrounds the nozzles which flows out of the chamber through the clearance space between the nozzles and the openings.

Accordingly, it is an object of the present invention to provide a filling machine which avoids by simple means the aforementioned shortcomings and drawbacks encountered in the prior art.

Another object of the present invention resides in a filling machine for filling a product, that has to be liquefied, into containers.

A further object of the present invention resides in a filling machine which is extremely simple in construction, utilizes conventional parts and operates in substantially the same manner as prior art machines, yet permits its use for filling products that have a relatively high melting point or relatively low boiling point.

A still further object of the present invention resides in a filling machine with environmental control which is relatively economical as regards energy requirements to maintain a desired temperature by minimizing the space which is temperature controlled.

Another object of the present invention resides in a filling machine which permits filling of molten materials, yet does not impair the length of service life of the machine parts.

A further object of the present invention resides in a filling machine of the type described above which is easy to handle by the operating personnel, easy to service by such personnel and obviates discomforts on the part of the personnel.

These and other objects, features and advantages of the present invention will become more apparent from the following description when taken in connection with the accompanying drawing which shows, for purposes of illustration only, one embodiment in accordance with the present invention and wherein.

Figure 1:
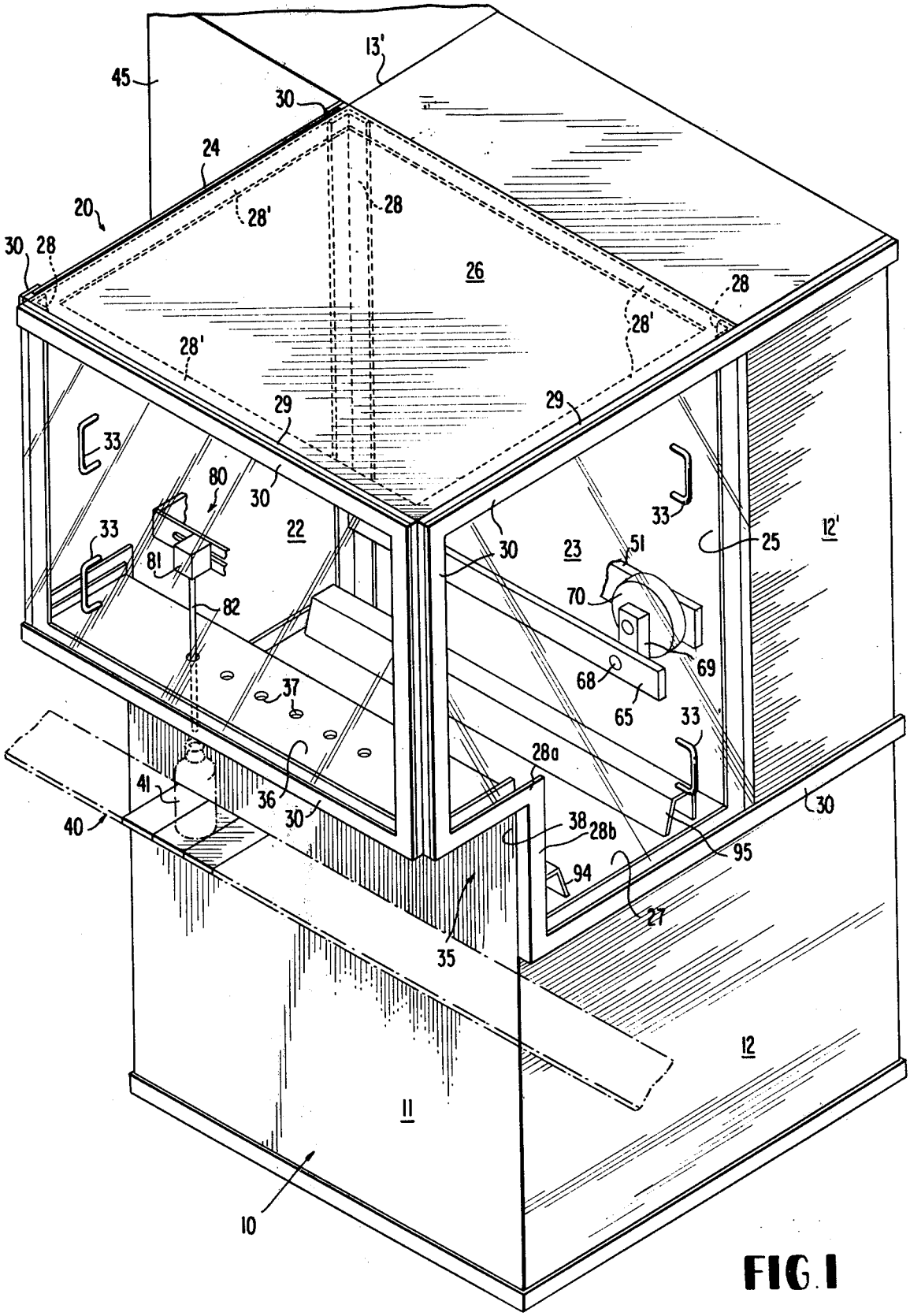
FIG. 1 is a perspective view of a filling machine with environmental control in accordance with the present invention.

Referring now to the drawing wherein like reference numerals are used throughout the various views to designate like parts, the filling machine of the present invention includes a lower part generally designated by reference numeral 10 as well as an upper chamber part generally designated by reference numeral 20. The lower part 10 includes a front panel 11 as well as a right side panel 12 and a left side panel 13. As can be seen in particular from FIGS. 1 and 4, the right side panel 12 as also the left side panel 13 are of a width greater than the width of the upper chamber part 20 and are each adjoined by an upper panel 12' and 13' which together with the back panel of the upper chamber part 20 form an extension of the rear compartment. The various panels are mounted on suitable conventional frame structures (not shown) such as angle iron, bracing members, etc., as normally used in this type of construction.

Figure 3:
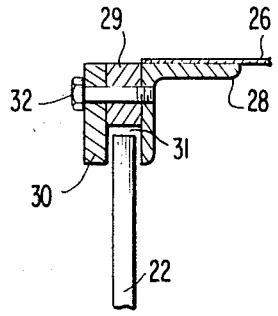
FIG. 3 is a partial cross-sectional view, on an enlarged scale, taken along line III—III of FIG. 2.
Figure 4:
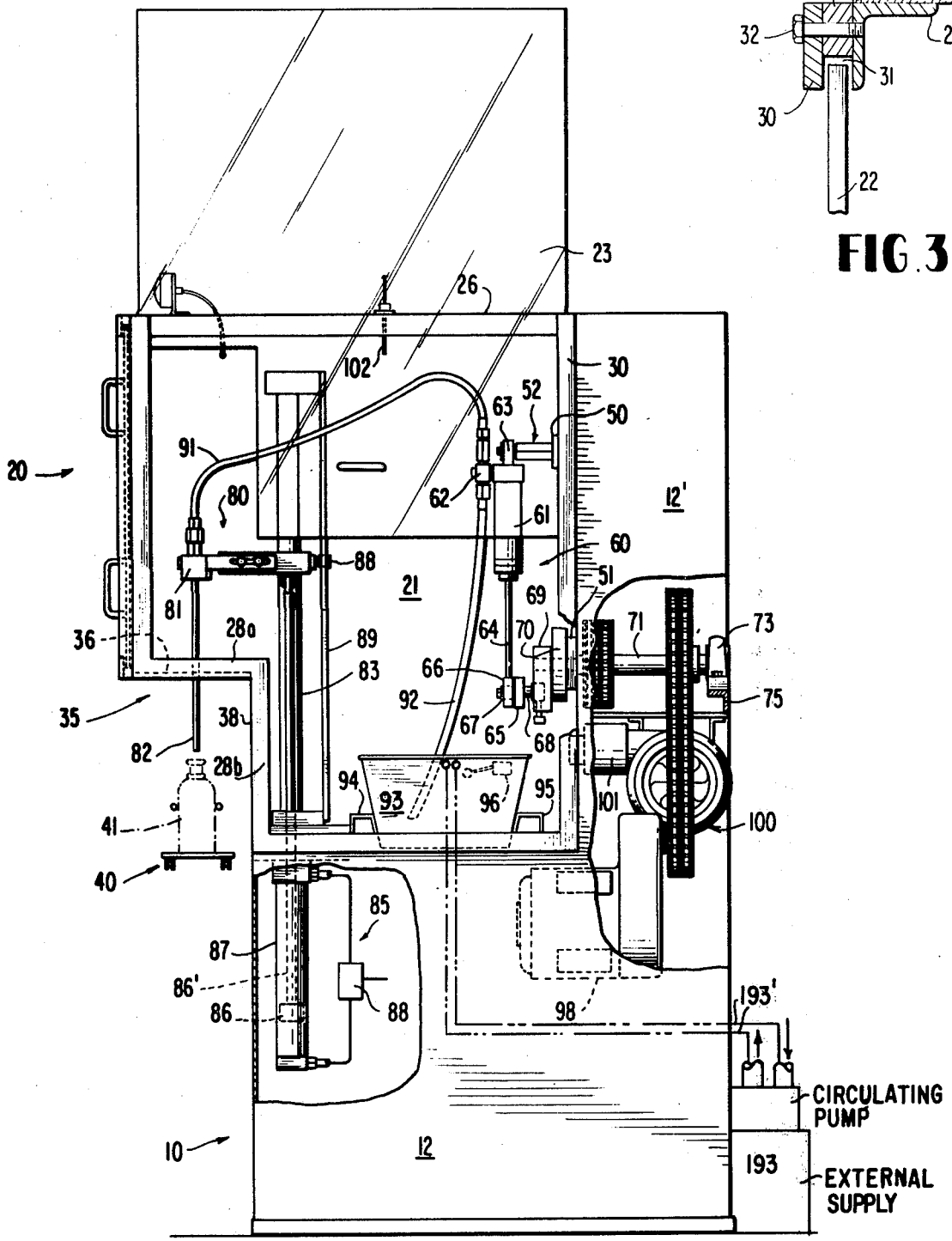
FIG. 4 is a right side elevational view of the machine of FIG. 1.

The upper part 20 which forms a chamber 21 equipped with environmental control includes a front panel 22, a right side panel 23, a left side panel 24 and a rear panel 25 as well as a top panel 26 and a bottom panel 27. The chamber 21 includes in its four corners appropriate structural angle members 28, interconnected by angle members 28' or other suitable structural parts so as to impart sufficient rigidity to the chamber cell and to the various chamber walls thereof to permit the support thereon of the pumping mechanism, etc. To enable sliding movement of the front, right and left panels 22, 23 and 24 for opening the chamber 21 and to provide ready access thereto, cover strips 30 are mounted over the angle members 28 or 28' by the interposition of spacer members 29 (FIG. 3) to provide a substantially U-shaped channel 31 in which the panels are able to slide without the use of any seals. Handles 33 are secured to the various panels to facilitate the handling thereof in their sliding movements. While FIG. 1 shows the right side panel 23 mounted for sliding movement in the horizontal direction, FIG. 4 illustrates a modified arrangement, according to which the panel 23 is adapted to slide in the vertical direction. If necessary, appropriate pins, pegs or other suitable stops may be used in the latter case to prevent the panel from sliding back down. The various parts 28 or 28', 29 and 30 are held together by suitable fastening screws 32.

The front panel 22 is somewhat shorter in the vertical direction than the rear panel 25, and the side panels 23 and 24 extend somewhat beyond the front panel 11 so that an essentially L-shaped ledge generally designated by reference numeral 35 is formed which includes a horizontal portion 36 provided with openings 37 for the passage therethrough of the nozzles during the bottom fill operation and a vertical portion 38 aligned with the front panel 11 of the lower part 10. Of course, the right and left angle members 28 are thereby suitably contoured to include horizontal and vertical portions **28*a* and 28*b* to take into account the L-shaped configuration of the ledge 35**.

Figure 2:
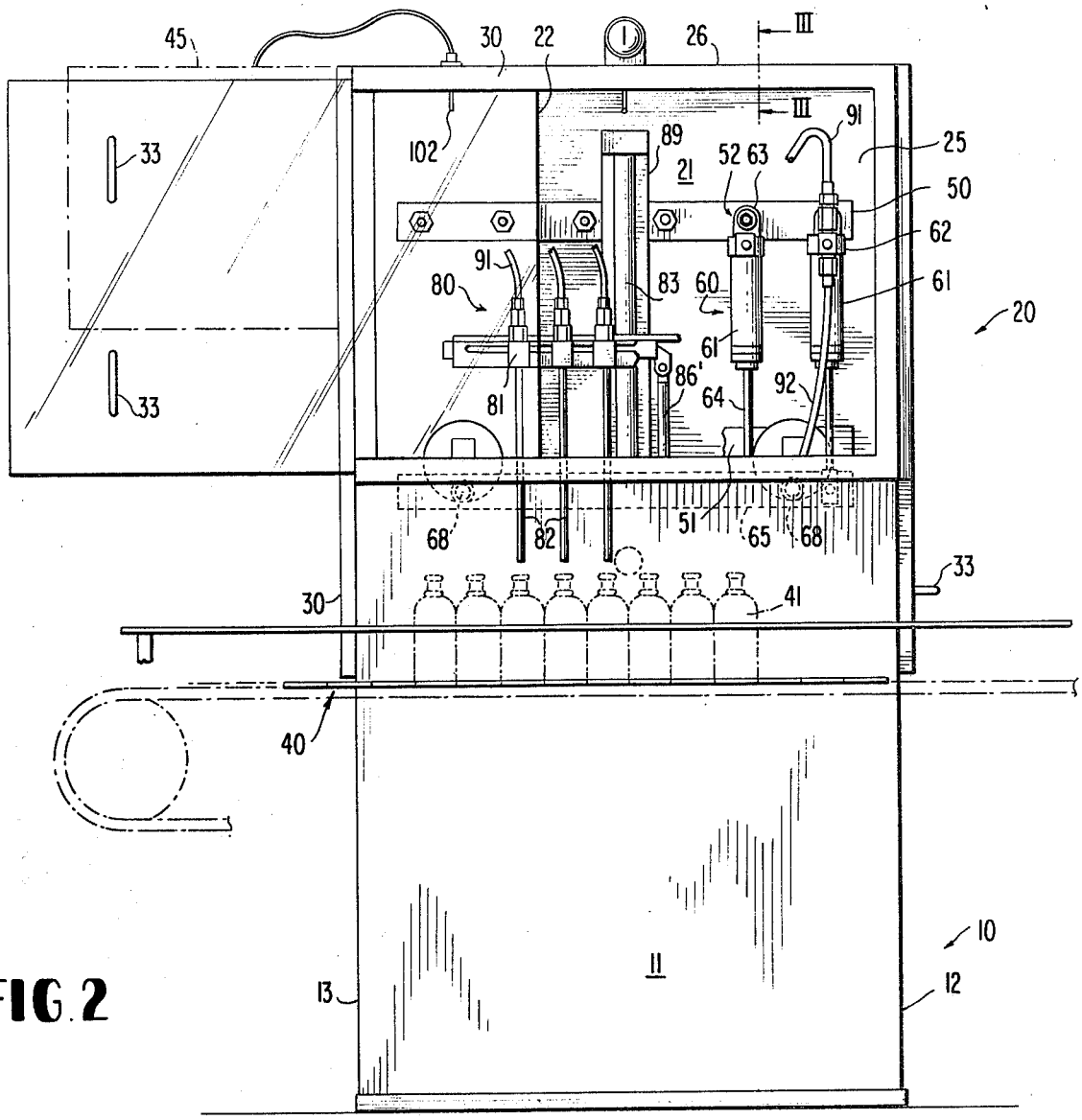
FIG. 2 is a front elevational view of the filling machine of FIG. 1.

A conventional conveyor generally designated by reference numeral 40 on which are transported the containers 41 is schematically shown in FIGS. 1 and 2 where the conveyor is generally designated by reference numeral 40 while the containers are designated by reference numeral 41. Any suitable electromechanical indexing mechanism such as disclosed in U.S. Pat. Nos. 3,067,786 and 3,237,661 may be used with the filling machine of the present invention. Additionally, especially in case of round containers, a star wheel indexing mechanism may be used, such as disclosed in the copending application Ser. No. 708,635, filed on July 26, 1976, in the name of Sidney Rosen and entitled "Star Wheel Indexing System for Automatic Filling Machines", now U.S. Pat. No. 4,083,389 the subject matter of which is incorporated herein by reference. A control box generally designated by reference numeral 45 which includes an appropriate control panel and houses the various controls of conventional construction, provides the various controls of the filling machines such as the speed control, the single cycle operation, etc. In the illustrated embodiment the control box 45 is mounted on the left side of the filling machine to the rear of the chamber 21, as shown in FIG. 1 and FIG. 2, and also includes the necessary temperature controls (not shown) for controlling the temperature within the chamber 21.

The chamber 21 which is thus delimited by the panels 22–25 as well as the top panel 26 and the bottom panel 27 accommodates all of the parts of the pumping mechanism used for metering and filling the molten material into the containers 41. The panels 22–27 are thereby preferably thermally insulated, for example, the top panel 26, the bottom panel 27 and the rear panel 25 may be made from suitable sheet metal provided with appropriate thermal insulation material while the slidable panels 22, 23 and 24 are preferably made from transparent plastic material with inherent heat insulation properties, such as from a polycarbon plastic, for example, of the type sold under the tradename "LEXAN".

An upper transversely extending mounting bar 50 and a lower transversely extending mounting bar 51 are suitably secured to the rear panel 25 and/or to the frame structure of the machine located to the rear thereof to support thereon a suitable number of filling units generally designated by reference numeral 60. The illustrated filling machine includes six such filling units, though this number may be varied without departing from the scope of this invention. The filling units of conventional construction each include a cylinder housing 61, a cylinder head 62, with a lateral valve housing containing the valves for the intake and discharge hose, an upper pump post mounting arm 63 and a piston rod 64. The upper pump post mounting arm 63 of a respective filling unit 60 is thereby mounted on a post pump assembly generally designated by reference numeral 52 which is secured to the upper mounting bar 50 and includes a pump post element and a bearing section for the upper pump post mounting arm (not shown). The construction may thereby be of the type disclosed in the copending application Serial No. 714,903, entitled "Convertible Filling Machine" filed on Aug. 16, 1976, now U.S. Pat. No. 4,077,441, in the name of Sidney Rosen et al, the subject matter of which is incorporated herein by reference. Drive shafts 71 and 72 (FIG. 5) which are supported in bearing brackets 73 and 74 mounted on a transverse frame member 75, thereby extend through appropriate holes in the rear panel 25 and in the lower transversely extending mounting bar 51. To drive in unison the various filling units 60 present in the chamber 21, the number of which may vary depending on the needs of the customer and may include, for example, six, eight or more filling units, the lower ends of the piston rod 64 are drivingly connected with a transversely extending link bar 65 by way of appropriate bearing sleeve housings 66 and bearing bushings 67 secured to the link bar 65 by appropriate cap screws and interposition of washers as more fully disclosed also in the aforementioned copending application, Ser. No. 714,903, now U.S. Pat. No. 4,077,441. The link bar 65 in turn is drivingly connected with the drive shafts 71 and 72 by way of eccentric pins 68 mounted on eccentrics 69 which are non-rotatingly secured to the drive shafts 71 and 72 and which may be of the known type enabling adjustment of the eccentricity to thereby adjust the stroke of the filling unit and therewith the amount of the molten product to be filled into the containers by each filling unit. To minimize friction, a bearing disk 70 of anti-friction material such as Nylon may be provided. As is quite apparent, as the eccentrics 69 are rotated by the drive shafts 71 and 72, the link bar 65 connected with the eccentric pins 68 will convert the rotary movement of the drive shafts 71 and 72 into reciprocating movements of the piston rods 64.

Figure 5:
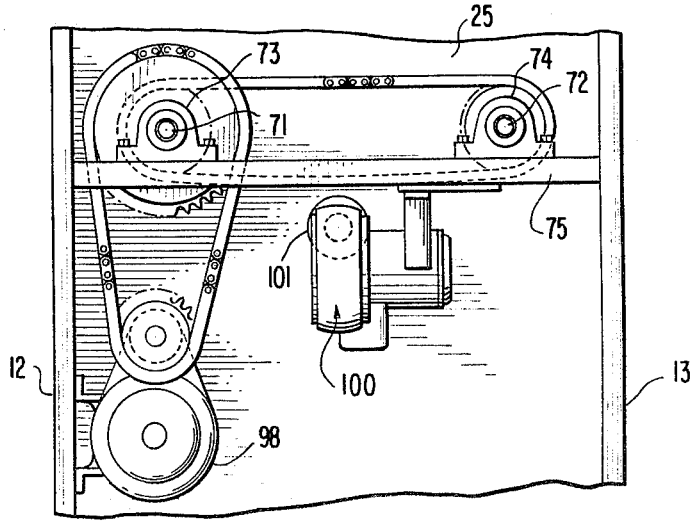
FIG. 5 is a rear elevational view of the machine of FIG. 1.

The nozzle support generally designated by reference numeral 80 includes a number of nozzle holders 81 for supporting a number of nozzles 82 corresponding to the number of filling units 60 in the machine. The nozzle support 80 is slidingly mounted on an upright support member 83 forming part of the bottom fill mechanism generally designated by reference numeral 85 which includes a piston 86 suitably connected by way of a piston rod 86' with the nozzle support 80 and slidable within a pneumatic cylinder 87 selectively and alternately supplied with air under pressure from a source of pressurized air by way of a solenoid valve 88 which itself is controlled by the operation of a suitable cam (not shown) mounted on the shaft 72. To prevent rotation of the nozzle support 80 about the upright 83, the former is provided with a guide pin 88 engaging in a groove of a vertical guide member 89. Of course, in lieu thereof, a mechanical bottom fill mechanism may also be provided utilizing a cam and cam follower as known in the prior art in order to cause the nozzles 82 to reciprocate with the vertical movements of the nozzle holders 81. Each nozzle 82 is connected with its respective filling unit 60 by way of a discharge hose 91 while the intake hose 92 is suitably connected with the external supply of molten liquid. Preferably an auxiliary reservoir 93 (FIG. 4) with which the various intake hoses 92 are connected in any known manner, for instance, by way of a manifold, is mounted between suitable brackets 94 and 95 on the bottom panel 27 and may be equipped with a float level control, only schematically indicated in FIG. 4 and designated by reference numeral 96, so as to maintain a constant level within the auxiliary reservoir 93. The auxiliary reservoir 93 may also be part of a circulatory system to circulate the liquified product continuously through the system, which includes an external supply for the liquified product, schematically indicated in FIG. 4 by reference numeral 193 and connected with the auxiliary reservoir 93 by way of lines 193'. The external supply 193 is of conventional construction and utilizes suitable heating means as well as pump means to assure circulation of the liquified product. The filling machine including its filling units 60 is driven by an electric motor 98 (FIG. 5) which is drivingly connected with the drive shafts 71 and 72 by way of appropriate gears and drive chains (FIGS. 4 and 5).

A blower generally designated by reference numeral 100 and including suitable heating means 101, for example, in the form of heat cartridges supplies heated air to the chamber as needed to maintain a constant temperature or temperature range within the chamber 21 as determined by a thermostatic control including a temperature sensing element 102 located within the chamber 21 and operatively connected with the electronic heat controls provided in the control box 45 that, in turn, assure the maintenance of the necessary temperature by means of the blower and heating means 100, 101. The temperature may thereby be maintained with an accuracy depending on the need. Normally, a temperature control with an accuracy of $\pm 5\%$ is adequate though a temperature control with an accuracy of $\pm 1\%$ of the desired temperature is also quite readily feasible in the system of the present invention by the use of conventional thermostatic controls.

In lieu of utilizing weighted valves in the filling units to selectively open and close the intake and discharge hoses, it is also possible to utilize a positively controlled system, such as described in the copening application Ser. No. 694,930, filed on June 11, 1976, entitled "Filling Unit with Air-Operated Spool Valve System", now U.S. Pat. No. 4,055,281 the subject matter of which is incorporated herein. In case this modified system is used with the filling machine of the present invention, the spool valve assembly for each filling unit would also have to be accommodated in the chamber 21 to also keep the spool valve at the requisite temperature and thereby to permit the filling of the molten material with the use of such a spool valve system.

The operation of the machine is otherwise quite similar to that of analogous prior art filling machines, i.e., the operation of the filling units 60 is so coordinated to the bottom fill mechanism that the nozzles are at or at least near their lowest position when the discharge stroke begins in the pumps and the filling is completed before the nozzles again leave the containers during the suction stroke of the pumps. As mentioned above, these operations are also correlated by a suitable indexing system to the movements of the containers on the conveyor so as to hold a predetermined number of containers stationary underneath the nozzles during each cycle of filling operation, to release the filled containers after completion of the filling operation and to bring in a new batch of the same number of containers for the next filling operation while the nozzles are in the retracted position.

The sliding panels 22, 23 and 24 as well as the openings 37 for the nozzles and similar openings for the drive shaft 71 and 72 are intentionally not sealed off so as to maintain an air movement within the chamber 21 due to the higher than atmospheric pressure prevailing therein, which helps to maintain the temperature as uniform as possible throughout the chamber 21. Of course, excessively large leakages should be avoided to achieve a good economy as regards the heating energy. Furthermore, by the use of good insulating material, the energy required to maintain the chamber 21 within a predetermined temperature range is relatively small, especially since the chamber 21 itself can be kept dimensionally relatively small by accommodating therein only those parts of the filling machine which come in contact with the molten material and therefore have to be kept at the elevated temperature to assure proper filling of the molten material.

While we have shown and described a filling machine for filling containers with a molten product, the present invention is not limited thereto but is equally applicable to filling products which have to be kept liquefied by cooling the same below their boiling point as, for example, for filling butane gas into cigarette lighters or the like. All that is necessary is to replace the heating cartridges with suitable cooling means so as to pass the air supplied by the blower 100 over suitable cooling coils or the like connected with a cooling system of conventional type.

Consequently, the present invention is not limited to the details shown and described herein but is susceptible of numerous changes and modifications as known to those skilled in the art and we therefore do not wish to be limited to the details shown and described herein but intend to cover all such changes and modifications as are encompassed by the scope of the appended claims.

We claim:

1. A filling machine for filling containers with a product which is not liquid at normal room temperature, comprising at least one nozzle means operable to be lowered into a respective container during the filling operation, at least one filling unit including a pump means having a suction stroke and a discharge stroke for accurately metering the amount of the product to be dispensed by said nozzle means into the respective container, connecting means including line means operable to connect the pump means with the nozzle means and to enable the product to be drawn into the pump means from a supply thereof during the suction stroke, and means for operating the filling machine including first means for operating each filling unit by drivingly connecting the pump means thereof with a drive means, second means for lowering and raising the nozzle means in timed relation to the filling operation of the filling unit, and third means for correlating the operation of said first and second means during a respective cycle of filling operation of the filling unit, which involves a suction stroke of the pump means occurring at least in part during the raising of the nozzle means by said second means, and a discharge stroke commencing after the nozzle means has been at least partially lowered into the respective container, characterized by chamber means including chamber walls delimiting the chamber for accommodating therein said pump means, said nozzle means and said line means, and temperature control means for maintaining the temperature in said chamber means at such a level that the product is in substantially liquid condition while being drawn in by the pump means during the suction stroke thereof and while being discharged through the nozzle means during the discharge stroke of the pump means, said drive means being disposed outside of said chamber means and being drivingly connected with said pump means through a chamber wall.

2. A filling machine according to claim 1, characterized in that the chamber means includes a wall portion extending generally in the horizontal direction and provided with a number of openings corresponding to the number of nozzle means to enable the reciprocating movements therethrough of the nozzle means in the up and down directions.

3. A filling machine according to claim 2, characterized in that the temperature control means includes means for feeding air with controlled temperature into said chamber means, and in that each opening which is devoid of any seal means, is slightly larger than the largest external dimension of the corresponding nozzle means passing therethrough so as to enable a flow of air therethrough from the chamber means into the atmosphere while limiting the amount of the thus throughflowing air flowing out of the chamber means into the atmosphere.

4. A filling machine according to claim 3, characterized in that the temperature control means includes a blower means feeding air with controlled temperature to said chamber means to maintain a pressure within said chamber means which is at least slightly above atmospheric pressure.

5. A filling machine according to claim 4, characterized in that said chamber means is provided with intentional leak means to enable the escape therethrough of air flowing from said chamber means into the surrounding atmosphere.

6. A filling machine according to claim 5, characterized in that said leak means are provided in part by said openings and in part by said chamber walls.

7. A filling machine according to claim 6, characterized in that some of said walls are panels slidable within guide means devoid of any seal means.

8. A filling machine according to claim 7, characterized in that a drive shaft which operatively connected the drive means with said pump means, extends through one of the walls with a clearance forming part of said leak means.

9. A filling machine according to claim 7, characterized in that said walls inclusive said panels are of a type providing thermal insulation.

10. A filling machine according to claim 9, characterized in that some of said walls are made of a substantially transparent, polycarbon plastic material having good thermal insulating qualities.

11. A filling machine according to claim 10, characterized in that some of said walls are made of sheet metal panels with thermal insulation affixed to the outside thereof.

12. A filling machine according to claim 10, characterized in that an auxiliary reservoir means for the liquefied product is provided within the chamber means, said auxiliary reservoir means being connected with the pump means by way of said line means.

13. A filling machine according to claim 12, characterized in that said auxiliary reservoir means includes a valve means for maintaining therein a predetermined level of said product.

14. A filling machine according to claim 12, characterized by means for circulating the liquefied product in a circulatory system including an external supply for the liquefied product and said auxiliary reservoir means.

15. A filling machine according to claim 10, characterized in that the product has a relatively high melting point, and in that the temperature control means maintains the temperature in said chamber means at least at said melting point.

16. A filling machine according to claim 10, characterized in that said product has a relatively low boiling point, and said temperature control means includes cooling means for keeping said chamber means at a temperature below said boiling point.

17. A filling machine according to claim 1, characterized in that substantially only said pump means, said nozzle means, said connecting means including said line means, guide means of said second means for guiding thereon said nozzle means during the up and down movements thereof, the parts of said first means drivingly connected directly with said pump means, and a heat sensing device forming part of said temperature control means are located within said chamber means.

18. A filling machine according to claim 17, characterized in that a plurality of drivingly interconnected pump means as well as an equal number of nozzle means which are supported on a common nozzle support guided by said guide means, are disposed within said chamber means.

19. A filling machine according to claim 1, characterized in that the chamber means is substantially enclosed on all sides thereof, and in that the temperature control means includes a blower means feeding air with controlled temperature to said chamber means to maintain a pressure within said chamber means which is at least slightly above atmospheric pressure.

20. A filling machine according to claim 19, characterized in that said chamber means is provided with intentional leak means to enable the escape therethrough of air flowing from said chamber means into the surrounding atmosphere.

21. A filling machine according to claim 20, characterized in that some of said walls are panels slidable within guide means devoid of any seal means.

22. A filling machine according to claim 20, characterized in that a drive shaft which operatively connected the drive means with said pump means, extends through one of the walls with a clearance forming part of said leak means.

23. A filling machine according to claim 1, characterized in that said walls inclusive said panels are of a type providing thermal insulation.

24. A filling machine according to claim 1, characterized in that an auxiliary reservoir means for the liquefied product is provided within the chamber means, said auxiliary reservoir means being connected with the pump means by way of said line means.

25. A filling machine according to claim 1, characterized in that said temperature control means is operable to maintain said level of temperature substantially throughout the chamber means.

26. A filling machine according to claim 25, characterized in that said temperature control means is operable to maintain said level of temperature substantially by convective heat transfer.

27. A filling machine according to claim 26, characterized in that the convective heat transfer is realized by a flow of temperature controlled air in said chamber means.

28. A filling machine according to claim 27, characterized in that predetermined leakage places are provided in said chamber means to enhance the flow of air throughout the chamber means.

29. A filling machine according to claim 1, characterized in that said temperature control means is operable to maintain said level of temperature at least primarily by convective heat transfer.

30. A filling machine according to claim 29, characterized in that the convective heat transfer is realized by a flow of temperature controlled air in said chamber means.

31. A filling machine according to claim 30, characterized in that predetermined leakage places are provided in said chamber means to enhance the flow of air throughout the chamber means.

32. A filling machine according to claim 1, characterized in that said temperature control means includes a blower located outside said chamber means and operable to supply a flow of temperature controlled air to said chamber means.

* * * * *